US010159344B2

(12) United States Patent
Mason et al.

(10) Patent No.: US 10,159,344 B2
(45) Date of Patent: Dec. 25, 2018

(54) PULL-OUT GUIDE

(71) Applicant: GRASS AMERICA, INC., Kernersville, NC (US)

(72) Inventors: Dale William Mason, Ashburn, VA (US); Christopher Blane Bowman, Mount Airy, NC (US); Cheng Jiang, Kernersville, NC (US); Manfred Peer, Walkertown, NC (US); Georg Domenig, Kernersville, NC (US); Cai Gengxi, Foshan (CN)

(73) Assignee: Grass America, Inc., Kernersville, NC (US)

( * ) Notice: Subject to any disclaimer, the term of this patent is extended or adjusted under 35 U.S.C. 154(b) by 157 days.

(21) Appl. No.: 15/244,449

(22) Filed: Aug. 23, 2016

(65) Prior Publication Data

US 2018/0055224 A1 Mar. 1, 2018

(51) Int. Cl.

| | |
|---|---|
| ***A47B 88/467*** | (2017.01) |
| ***A47B 88/04*** | (2006.01) |
| ***A47B 88/10*** | (2006.01) |
| ***A47B 88/14*** | (2006.01) |
| ***A47B 88/16*** | (2006.01) |

(52) U.S. Cl.

CPC ..... *A47B 88/467* (2017.01); *A47B 88/047* (2013.01); *A47B 88/0466* (2013.01); *A47B 88/10* (2013.01); *A47B 88/14* (2013.01); *A47B 88/16* (2013.01); *A47B 2210/004* (2013.01); *A47B 2210/0016* (2013.01); *A47B 2210/0059* (2013.01); *A47B 2210/0091* (2013.01)

(58) Field of Classification Search

CPC ... A47B 88/14; A47B 88/0466; A47B 88/047; A47B 88/10; A47B 88/16; A47B 2210/0016; A47B 2210/004; A47B 2210/0091

See application file for complete search history.

(56) References Cited

U.S. PATENT DOCUMENTS 3,912,341 A * 10/1975 Stein ..... A47B 88/493 312/331
5,775,788 A * 7/1998 Sasse ..... A47B 88/487 312/334.11
9,651,088 B2 * 5/2017 Park ..... F16C 29/048
(Continued)

FOREIGN PATENT DOCUMENTS

WO WO-2014200125 A1 * 12/2014 ..... F16C 29/048

*Primary Examiner* — Hanh V Tran
(74) *Attorney, Agent, or Firm* — Burr & Brown, PLLC

(57) ABSTRACT

A pull-out drawer guide having a cabinet rail for attaching to a furniture cabinet, a drawer rail for attaching to a drawer, a roller carriage having rollers, which, during relative movement of the rails, roll on a guide face of the respective rail. The pull-out guide includes on the cabinet rail, an automatic retraction mechanism which, by means of a catch element, catches the drawer rail in a closure movement and moves it to a closed position relative to the cabinet rail. The cabinet rail has a stop element, and the drawer rail has an abutment element, wherein, at a catch position of the cabinet rail, a distance between the stop and abutment elements is smaller than a maximum length of movement of a coupling element of a force accumulator of the automatic retraction mechanism, the distance being parallel to a direction of movement of the drawer rail.

12 Claims, 5 Drawing Sheets

(56) References Cited

U.S. PATENT DOCUMENTS

2004/0007952 A1* 1/2004 Domenig ..... A47B 88/40 312/334.1
2006/0091770 A1* 5/2006 Ritter ..... A47B 88/493 312/334.13
2011/0115353 A1* 5/2011 Domenig ..... A47B 88/463 312/333
2012/0248956 A1* 10/2012 Netzer ..... A47B 88/493 312/334.9
2013/0076221 A1* 3/2013 Hammerle ..... A47B 88/14 312/334.1
2013/0127319 A1* 5/2013 Breisacher ..... A47B 88/437 312/334.23
2013/0193824 A1* 8/2013 Koenig ..... A47B 88/0466 312/334.11
2014/0009054 A1* 1/2014 Salice ..... A47B 88/16 312/334.44
2014/0079346 A1* 3/2014 Chung ..... F16C 33/3843 384/18
2014/0241651 A1* 8/2014 Greussing ..... A47B 88/487 384/19
2014/0300262 A1* 10/2014 Flogaus ..... A47B 88/47 312/319.1
2015/0131929 A1* 5/2015 Park ..... A47B 88/047 384/21
2015/0147009 A1* 5/2015 Jahrling ..... A47B 88/14 384/49
2015/0216303 A1* 8/2015 Rehage ..... F16C 29/046 312/334.17
2015/0230604 A1* 8/2015 Violand ..... A47B 88/10 312/334.12
2015/0257536 A1* 9/2015 Chen ..... A47B 88/0466 384/18
2016/0081473 A1* 3/2016 Jiang ..... A47B 88/0466 312/334.33
2016/0242545 A1* 8/2016 Violand ..... A47B 88/14

* cited by examiner

PULL-OUT GUIDE

FIELD OF THE INVENTION

The present invention relates to a pull-out guide for guiding a drawer, and to a drawer or an item of furniture having such a pull-out guide.

BACKGROUND OF THE INVENTION

Pull-out guides for guiding a drawer have already become known in many different embodiments as a full-extension pull-out with a cabinet rail, a central rail and a drawer rail, and as a partial or simple pull-out with a cabinet rail and a drawer rail. One application relates to base-mounted guides, for example, in which the pull-out guides are attached below a drawer base of a drawer which is made of wood, for example. Particularly in pull-outs which consist of a cabinet rail and of a drawer rail and which are arranged in what is called a face frame arrangement on the item of furniture, a pull-out length of the pull-out and/or a weight load is limited.

SUMMARY OF THE INVENTION

The object of the present invention is to make available an improved pull-out guide, in particular, to make available a pull-out guide with a comparatively high degree of stability.

The present invention proceeds from a pull-out guide for guiding a drawer, having a cabinet rail for attaching to a furniture cabinet, and a drawer rail for attaching to a drawer, wherein a roller carriage is provided, the rollers of which roller carriage, during a movement of the rails relative to each other, roll on a guide face of the respective rail.

The drawer rail is advantageously mounted movably on the cabinet rail in such a way that it can move relative to the cabinet rail between an in particular fully closed state and an in particular fully opened state.

The essential aspect of the present invention is now to be seen in the fact that the roller carriage has a latch element in order to avoid lateral movement play of the drawer rail relative to the roller carriage.

A lateral guiding and/or supporting of the drawer rail by rollers of the roller carriage in the opened state, in particular, in the fully opened state, is comparatively short. For a maximum possible pull-out length of the drawer rail relative to the cabinet rail into an in particular fully opened state, a lateral guiding by rollers of the roller carriage parallel to the direction of movement of the drawer rail is thus to be chosen to be short, for example. In this way, a lateral play of the drawer rail relative to the roller carriage and/or the cabinet rail is comparatively increased. The latch element is provided for the purpose of reducing and/or avoiding the increased movement play of the drawer rail, which is present for the abovementioned reasons.

In other words, the latch element is advantageously provided to avoid, advantageously to minimize or reduce lateral movement play of the drawer rail relative to the roller carriage and/or relative to the cabinet rail. A lateral movement of the drawer rail is regarded as a movement perpendicular to a pull-out direction of the drawer rail and parallel to a guide face of the cabinet rail, on which the roller carriage is mounted and on which, therefore, the drawer rail is also mounted via the roller carriage, for example.

A main body of the roller carriage advantageously comprises the latch element. The main body is designed, for example, as a cage on which, in particular, the rollers of the roller carriage are mounted movably. The latch element forms, for example, an area of an outside of the main body. In this way, the latch element is comparatively easy to produce and arrange. For example, the main body is made of plastic. In this way, the main body can be provided comparatively cost-effectively as an injection-molded part or injection-compressed part.

The latch element preferably protrudes from a lateral plane of the outside of the main body, in particular, in a bulging formation. The latch element is expediently positioned in the area of an edge or corner of the main body and, for example, configured as a fixed element. If appropriate, the latch element and the main body are formed in one piece. For example, the latch element protrudes like a nose from an outside of the main body.

It is also advantageous that the latch element has a bearing face on which the drawer rail, in particular, a guide face of the drawer rail, rests. The guide face of the drawer rail is, for example, directed so as to face toward a guide face of the cabinet rail. For example, a surface normal of the guide face of the drawer rail, which can come to rest on the bearing face of the latch element, is perpendicular to a pull-out direction or direction of movement of the drawer rail relative to the cabinet rail. A bearing face of the latch element is preferably present on the roller carriage at the same distance as or farther from the guide face of the cabinet rail, protruding in the direction of a guide face of the drawer rail, than a bearing face of a roller, which movably supports the drawer rail on the guide face of the drawer rail, in particular, laterally with respect to the cabinet rail. It also proves advantageous that the guide face of the drawer rail is designed to rest both on rollers of the roller carriage and also on the bearing face of the latch element.

The latch element is preferably present on the roller carriage in such a way that it does not touch the guide face of the cabinet rail.

It is also advantageous that the roller carriage is present between the cabinet rail and the drawer rail in such a way that, during a movement of the drawer rail relative to the cabinet rail, the roller carriage is moved, in particular, twisted, in such a way that the latch element advantageously does not touch the guide face of the drawer rail, or there is relatively little contact present. By contrast, there is relatively large contact of the latch element with the guide face of the drawer rail, for example, in a stationary position of the drawer rail relative to the cabinet rail.

In particular, during an opening movement and/or closure movement, a guide face of the drawer rail slides on the bearing face of the latch element and/or along the bearing face of the latch element. For example, the bearing face is designed as a slide bearing.

It is further proposed that the roller carriage has two latch elements, which are designed lying opposite each other on the roller carriage.

Advantageously, the two latch elements, seen in the direction of movement of the pull-out guide, are offset relative to each other on the roller carriage, in particular, diagonally offset relative to each other.

By means of a diagonal arrangement of the latch elements on the roller carriage, an, in particular, lateral movement play of the drawer rail relative to the roller carriage and/or to the cabinet rail in a movement plane of two drawer rails of a drawer and perpendicular to the direction of movement of the drawer rail can be limited, e.g. in a first direction, wherein said movement play is pronounced in a second direction counter to the first direction. If the roller carriages of the two drawer rails of the drawer are present with mirror symmetry, the movement play of the drawer is thus limited e.g. both in the first direction and in the second direction.

Moreover, it appears advantageous if several latch elements are present on the roller carriage. It is advantageous, in particular, if four latch elements are present on the roller carriage. Advantageously, two latch elements are present at a distance from each other on one side of the roller carriage. It is conceivable, for example, that two latch elements are present behind each other or next to each other on one side of the roller carriage or of the main body of the roller carriage. If the roller carriage comprises four latch elements, positions of the four latch elements advantageously form a rectangle in a plan view of the roller carriage.

It also proves advantageous that the latch element is elastic and/or resilient. For example, the latch element comprises a spring element. However, it is also conceivable that the latch element is dimensionally stable and/or positionally fixed on the roller carriage.

If the latch element is elastic, jamming or blocking of a movement of the drawer rail relative to the cabinet rail is avoided in a movement of the drawer rail relative to the cabinet rail.

In another advantageous embodiment of the present invention, the pull-out guide comprises, on the cabinet rail, an automatic retraction mechanism which, by means of a catch element, catches the drawer rail in a closure movement and moves it to a closed position, in particular, a fully closed position, relative to the cabinet rail, wherein the cabinet rail has a stop element, and the drawer rail has an abutment element, wherein, at a catch position of the cabinet rail, a distance between the stop element and the abutment element is smaller than a maximum length of movement of a coupling element of a force accumulator of the automatic retraction mechanism, wherein the distance is to be seen parallel to a direction of movement of the drawer rail.

The force accumulator advantageously comprises a coupling element which can be coupled to the catch element of the automatic retraction mechanism; in particular, it is fixedly connected, for example, to the catch element of the automatic retraction mechanism. It is conceivable, for example, that the coupling element of the force accumulator executes a linear movement during a charging and/or discharging of the force accumulator, e.g. a lifting movement. This linear movement is advantageously parallel to the direction of movement of the drawer rail.

In particular, the coupling element comprises a holding member which, in the state with the automatic retraction mechanism not arranged on the pull-out guide, strikes against an abutment of the retraction mechanism in the fully charged state of the force accumulator and in the fully discharged state of the force accumulator.

Advantageously, the abutment element of the drawer rail strikes against the stop element during a closure movement of the drawer rail. In particular, a force accumulator of the retraction mechanism is thereby maintained under prestressing.

The position of the stop element on the cabinet rail and/or of the abutment element on the drawer rail is advantageously such that, in the closure movement of the pull-out guide, the abutment element of the drawer rail strikes against the stop element before the force accumulator of the retraction mechanism reaches an, in particular, final end position, or before the holding member of the coupling element of the retraction mechanism strikes against the abutment of the retraction mechanism.

It is also conceivable that the abutment element strikes against the stop element when, in a closure movement, the drawer rail travels past a closure position relative to the cabinet rail. The abutment position of the abutment element on the stop element in this case forms a second, final closure position of the drawer rail on the cabinet rail and thus serves as a safety feature of a closure movement of the drawer rail.

It also proves advantageous that the stop element is bent out from the cabinet rail.

The stop element is advantageously present as a flag, in particular, as a metallic and, in particular, rectangular flag. In particular, a narrow side face of the flag forms an abutment for the abutment element of the drawer rail.

The stop element is preferably bent out from a surface extending parallel to the guide face of the cabinet rail on which the roller carriage is mounted. In particular, the stop element is bent upward in the direction of a surface normal of the guide face. The guide face is advantageously parallel to a movement plane of two drawer rails of a drawer in the state when arranged on the drawer.

It is also conceivable that the stop element and/or the abutment element is made of plastic. For example, the stop element is clipped and/or clamped onto the cabinet rail. Advantageously, the stop element is present in a front end area, in particular, a front third, of the cabinet rail.

It is also conceivable that a position of the stop element and/or of the abutment element is adjustable. By positioning the stop element on the cabinet rail and/or by positioning the abutment element on the drawer rail, for example, a closure position of the drawer relative to an item of furniture on which the drawer is arranged is adjustable. This is particularly advantageous when the stop element and the abutment element are present in a front end area of the cabinet rail and of the drawer rail, such that at least one of the two elements can be reached relatively easily and/or adjusted relatively easily by a fitter. Indeed, in a state with the pull-out guide installed on an item of furniture, a retraction mechanism of the pull-out guide is quite difficult or impossible for a fitter to reach in most known designs of pull-out guides. It is thus quite difficult for a fitter to adjust a closure position, if appropriate using the retraction mechanism.

The stop element and/or the abutment element can comprise a damping member, by which means, for example, an abutment noise is attenuated, in particular, avoided. Advantageously, a movement of the drawer rail, when the abutment element strikes against the stop element, is damped and/or relatively gently cushioned.

It is also conceivable that the stop element is present in a laterally protruding manner on the cabinet rail, protruding in the direction of the drawer rail. In particular, the stop element protrudes laterally from an inner face of a folded-back outside of the cabinet rail, wherein an outer face of the outside of the cabinet rail is provided for attachment to the item of furniture.

Moreover, it is advantageous that the abutment element is mounted on the drawer rail.

For example, the abutment element is clipped and/or clamped onto the drawer rail. Advantageously, the abutment element is clipped onto the drawer rail in the direction of the guide face, e.g. onto the guide face, by means of which the drawer rail is mounted on the cabinet rail via the roller carriage.

It is also conceivable that the abutment element is bent out from the drawer rail.

Moreover, it is conceivable that a position of the abutment element is adjustable. Advantageously, the abutment element is present in a front end area, in particular, in a front third, of the drawer rail.

The abutment element preferably protrudes laterally from the drawer rail. In particular, it protrudes perpendicularly with respect to the direction of movement of the drawer rail. For example, the abutment element protrudes from the drawer rail in the direction of the outside of the cabinet rail.

In another advantageous embodiment of the present invention, a first rail of the pull-out guide comprises a bearing member, and a further rail comprises a support element, wherein the bearing member, in the fully opened state of the first rail relative to the further rail, touches the support element in order to support the first rail.

The pull-out guide can be designed as a partial pull-out or as a full-extension pull-out. If the pull-out guide is designed as a full-extension pull-out, the pull-out guide comprises the cabinet rail, a central rail and the drawer rail.

Advantageously, the cabinet rail and/or the central rail of the pull-out guide comprises a bearing member, and the central rail and/or the drawer rail has a support element, wherein the bearing member, in the fully opened state of the drawer rail and/or central rail relative to the central rail and/or cabinet rail, touches the support element in order to support the drawer rail and/or the central rail.

It is moreover conceivable that the bearing member and the support element are present the other way round on the pull-out guide. In this case, the bearing member bears on the support element, in particular, in the fully opened state of the pull-out guide.

By designing the pull-out guide with a support element and with a bearing member, a permissible drawer weight can advantageously be increased. For example, a comparatively larger drawer can thus be mounted on the pull-out guide, or a permissible weight of the contents of the drawer is increased, for example.

Preferably, the bearing member is formed on a front end area of the first rail, and the support element is present on the further rail, at a rear end area of the rail. In this case, front is to be seen in the direction of opening of the pull-out guide and rear is to be seen counter to the direction of opening, in the closure direction of the pull-out guide.

For example, the support element is present, for example, in a rear third of a length of the further rail, e.g. in a rear fourth, for example, in a rear fifth, in particular, in a rear tenth of the length of the further rail. Preferably, the bearing member is present in a front third of a length of the first rail, e.g. in a front fourth, for example, in a front fifth, e.g. in a front tenth, in particular, in a front twentieth of the length of the first rail. For example, an edge of the bearing member forms a partial area of a front edge of the first rail.

Advantageously, the bearing member touches the support element of the drawer rail exclusively in the fully opened state of the drawer rail, in particular, at a support position and/or around an area of the support position on a support face.

The support element is preferably designed as a bent sheet-metal part. For example, the support element is fixedly connected to the drawer rail, e.g. clamped or clipped. The support element is, for example, connected to the drawer rail in a non-releasable manner. The support element is, for example, welded, bonded and/or riveted onto the drawer rail. It is also conceivable that the support element is bent out from the drawer rail. For example, the support element is in this case present as a tab and/or tongue. It is also conceivable that the support element is elastic.

It also proves advantageous that the bearing member is bent out from the cabinet rail.

Advantageously, the bearing member is bent out from the cabinet rail in a front end area of the cabinet rail. The support face of the support position is preferably parallel to a guide face of the cabinet rail and parallel to a movement plane of the drawer that can be arranged on the pull-out guide.

It is moreover advantageous that the support element comprises a bearing roller. The bearing roller is preferably made of metal and/or plastic. It is conceivable, for example, that the bearing roller is designed like a tire. For example, the bearing roller comprises a rubber lining on its circumference. In this way, possible noise development caused by contact of the bearing roller with the support element is minimized, e.g. damped. In this way too, friction between the support element and the bearing member is advantageously increased upon contact, in such a way that the bearing roller, during a movement of the drawer rail relative to the cabinet rail, rolls across the support face and, for example, does not slide. Advantageously, upon contact with the support element, the bearing roller does not brake a movement of the drawer rail.

Advantageously, a rotation axle of the bearing roller is formed perpendicularly with respect to the direction of movement of the drawer rail. In particular, the rotation axle is parallel to a movement plane of a drawer that can be arranged on the pull-out guide.

It is moreover conceivable that the support element comprises a spring arrangement. For example, the bearing roller and/or a rotation axle of the bearing roller is spring-mounted on the support element. It is also conceivable that the support element is mounted on the drawer rail in a manner cushioned by the spring arrangement.

The support element preferably comprises a slide bearing.

It is likewise advantageous that the bearing member has a ramp for the bearing roller and/or the slide bearing of the support element.

Advantageously, the bearing roller travels or rolls and/or the slide bearing slides, in an opening movement of the drawer rail, when the bearing member is reached, along a support face of the ramp of the bearing member, in particular, obliquely upward in the direction of the support position, onto the support position of the support face, e.g. with a direction component perpendicular to the movement plane of the drawer that can be arranged.

It is conceivable that the ramp on the bearing member is elastic and/or resilient or dimensionally stable. It is also conceivable that the ramp has, on the side of the support face, a layer, e.g. a coating, e.g. a plastic coating. In this way, it is possible to increase or to minimize friction between the ramp and the support element. The coating can also have a damping action.

It is moreover conceivable that the pull-out guide is designed as a full-extension pull-out consisting of a cabinet rail, a central rail and a drawer rail. In this case, the stop element can be formed on the cabinet rail and/or on the central rail, and the abutment element can be arranged on the central rail and/or the drawer rail. Moreover, it is conceivable in this case that a roller carriage is present between the cabinet rail and the central rail and/or between the central rail and the drawer rail. It is likewise conceivable in this case that the bearing member is present on the cabinet rail and/or the central rail, and the support element is present on the central rail and/or the drawer rail.

BRIEF DESCRIPTION OF THE DRAWINGS

An illustrative embodiment according to the present invention is explained in more detail below specifying further advantages and details and with reference to schematic drawings, in which.

DETAILED DESCRIPTION OF THE INVENTION

Figures 1, 2, 3, 4, 5:
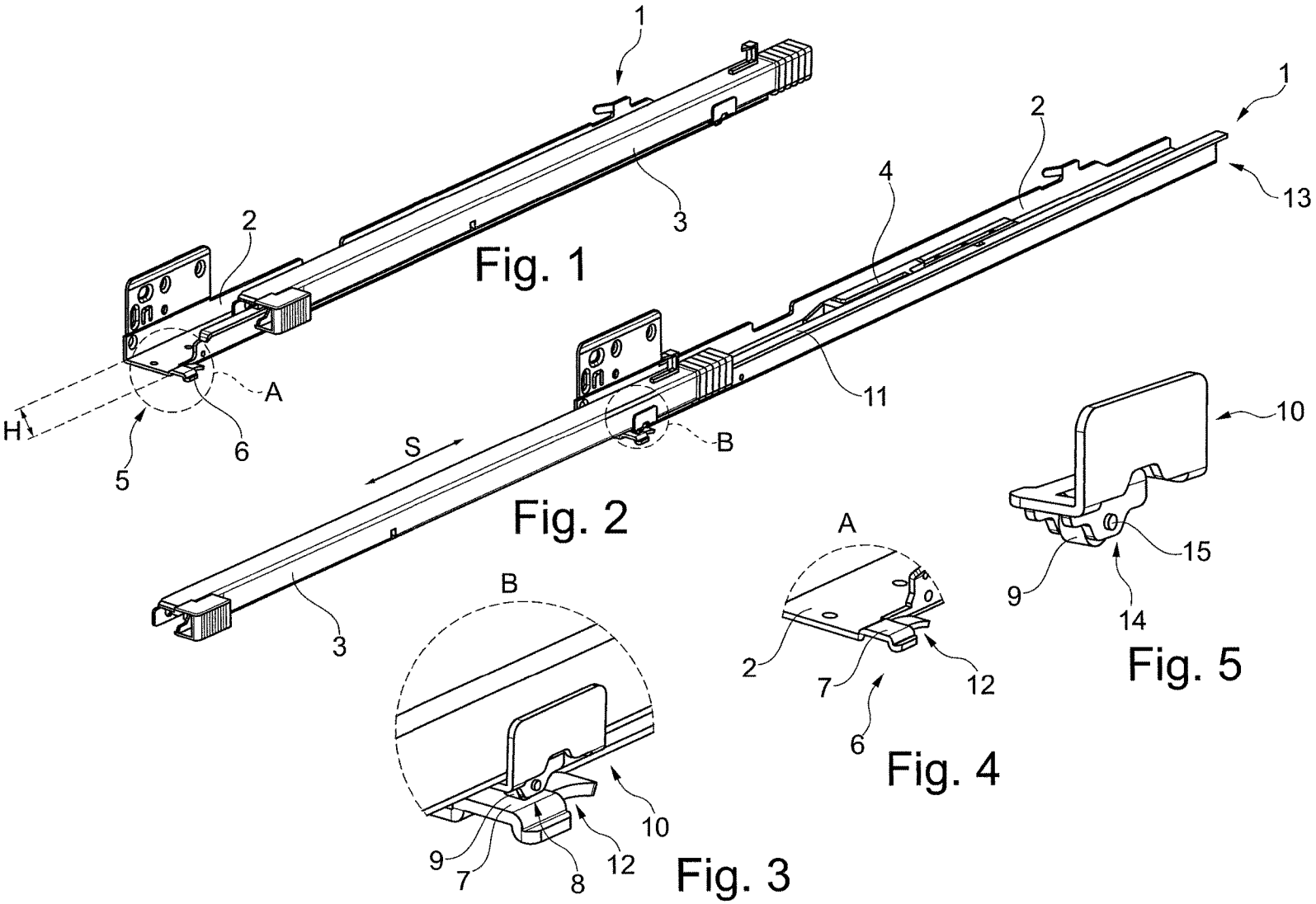
FIG. 1 shows a perspective view, laterally from the inside, front and above, of a pull-out guide according to the present invention in a closed state.
FIG. 2 shows the pull-out guide according to FIG. 1 in an opened state, in a perspective view laterally from the inside, front and above.
FIGS. 3 and 4 show a perspective view of enlarged details A and B of FIGS. 1 and 2.
FIG. 5 shows a perspective view, laterally from the inside, front and above, of a support element according to the present invention.
Figures 10, 11:
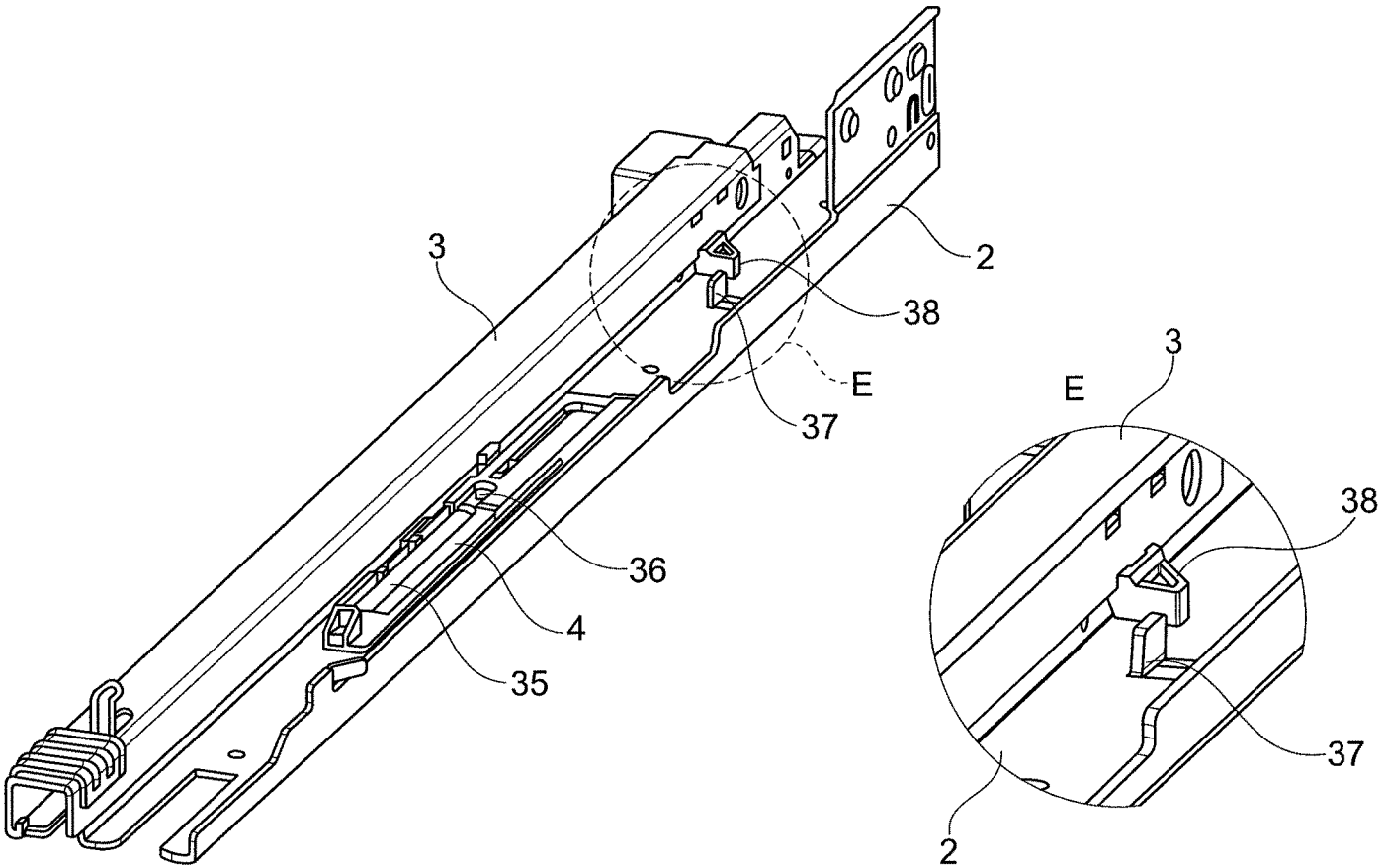
FIG. 10 shows a perspective view, laterally from the outside, rear and above, of the pull-out guide according to FIG. 1.
FIG. 11 shows a perspective view of an enlarged detail E of FIG. 10.

A pull-out guide 1 according to the present invention comprises a cabinet rail 2 and, mounted movably relative to the cabinet rail 2, a drawer rail 3 (FIGS. 1 and 2). The pull-out guide 1 is designed, for example, as a face-frame pull-out guide. Moreover, the pull-out guide 1 can have a retraction mechanism 4, which is arranged on the cabinet rail 2 in such a way that, in a closure movement of the drawer rail 3, it couples onto a catch of the drawer rail 3 and moves the drawer rail 3 from a partially closed position to a fully closed position relative to the cabinet rail 2. The retraction mechanism 4 comprises, inter alia, a force accumulator 35 and a coupling element 36 (FIG. 10). The force accumulator 35 comprises, for example, a cylinder in which a connecting rod can execute a linear lifting movement. The coupling element 36 is present, for example, at one end of the connecting rod.

At a front end area 5 of the cabinet rail 2, a bearing member 6 is bent out in a tongue shape on the cabinet rail 2. The bearing member 6 is, for example, U-shaped in cross section, in particular, perpendicular to a direction of movement S of the drawer rail 3. In this way, the bearing member 6 is dimensionally stable (FIGS. 4 and 5).

The bearing member 6 comprises a support face 7 which has a support position 8 on which a bearing roller 9 of a support element 10 stands and/or rests and/or supports when the drawer rail 3 is located in a fully opened position relative to the cabinet rail 2 (FIG. 2).

The support face 7 of the bearing member 6 is parallel to the direction of movement S of the drawer rail 3 and parallel to a guide face 11 on the cabinet rail 2.

Moreover, the bearing member 6 comprises a ramp 12 which protrudes from the bearing member 6 parallel to the direction of movement S of the drawer rail 3 in the direction of a rear end area 13 of the pull-out guide 1. The ramp 6 is shaped like a flag and has a downward curvature away from the drawer rail 3. In this way, in an opening movement of the drawer rail 3 relative to the cabinet rail 2, the bearing roller 9 of the support element 10 can roll onto the support face 7 as it were free from obstruction, e.g. without having to overcome an edge or step, in the direction of the support position 8.

The support element 10 is designed as a sheet-metal part bent in an L shape and, for example, riveted and/or welded onto the drawer rail 3 (FIGS. 2 and 5). On an underside 14 of the support element 10, the bearing roller 9 is mounted rotatably on the support element 10 via a rotation axle 15. In the state with the support element 10 arranged on the drawer rail 3, the rotation axle 15 is perpendicular to a direction of movement S of the drawer rail 3 and parallel to a support face 7 of the bearing member 6.

The support element 10 is, in particular, formed on the drawer rail 3 in such a way that vertical forces which act on the drawer rail 3, perpendicular to the direction of movement S of the drawer rail 3, are transferred via the support element 10 to the bearing member 6 and thus to the cabinet rail 2. In this way, the pull-out guide 1, in the fully opened state of the pull-out guide 1, can absorb or take up quite considerable vertical forces without the pull-out guide 1 being damaged.

Advantageously, the bearing member 6 and the support element 10 are arranged on the cabinet rail 2 and on the drawer rail 3 in such a way that, particularly, when the pull-out guide 1 is designed as a base-mounted pull-out guide, an overall height H of the pull-out guide 1 is not increased by the bearing member 6 and the support element 10. For example, the bearing member 6 and the support element 10 protrude laterally on the cabinet rail 2 and the drawer rail 3.

Figure 6:
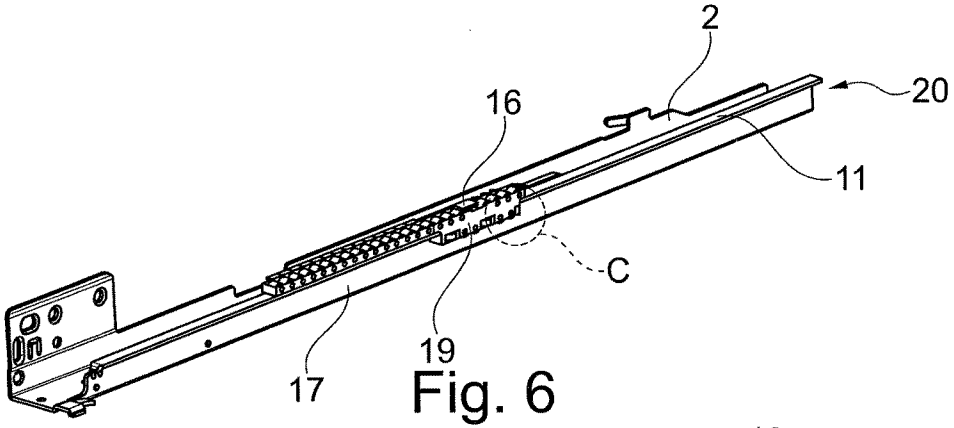
FIGS. 6 and 7 each show a perspective view of the pull-out guide according to FIG. 1 without an arranged drawer rail, firstly in a view laterally from the inside, front and above (FIG. 6) and secondly, in a diagonally opposite view, laterally from the outside, rear and above (FIG. 7)
Figure 7:
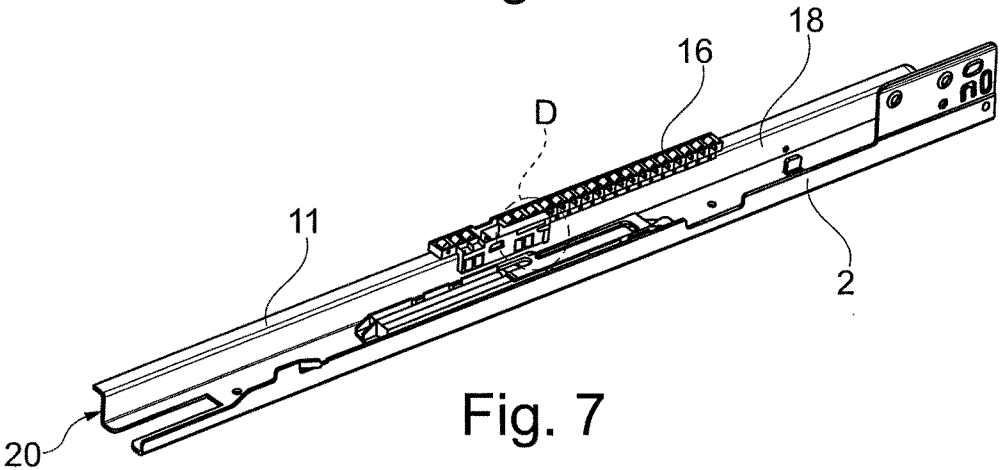

The drawer rail 3 is supported movably on the cabinet rail 2 by means of a roller carriage 16. The roller carriage 16 rolls with rollers on guide faces 11, 17, 18 of the cabinet rail 2. The guide faces 17 and 18 serve here for the lateral guiding of the roller carriage 16 on the cabinet rail 2 (FIGS. 6 and 7).

The roller carriage 16 comprises a cage 19 in which the rollers of the roller carriage 16 are mounted movably. The cage 19 is U-shaped in cross section or helical, such that, in the arranged state on the cabinet rail 2, it engages, for example, around an L-shaped edge 20 of the cabinet rail 2 on which the guide faces 11, 17, 18 are formed.

Latch elements 23, 24 protruding in the shape of cylinders are present on mutually opposite outsides 21, 22 of the roller carriage 16. Advantageously, bearing faces 25, 26 of the latch elements 23, 24 protrude from the cage 19 of the roller carriage 16 in such a way that lateral movement play of an arranged drawer rail 3 is avoided.

Figure 8:
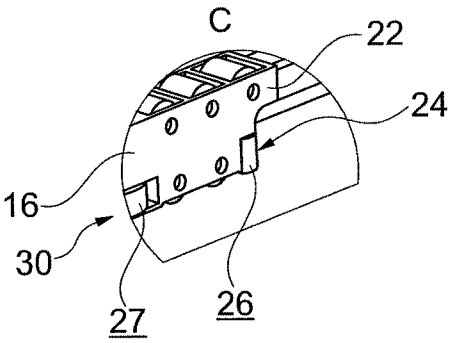
FIGS. 8 and 9 each show a perspective view of enlarged details C and D of FIGS. 6 and 7.
Figure 9:
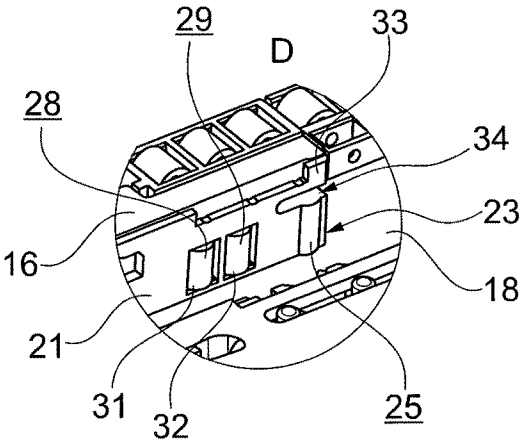

It is conceivable that the bearing faces 25, 26 of the latch elements 23, 24 each form, with roll faces 27, 28, 29 of rollers 30, 31, 32 of the roller carriage 16, a plane for resting on guide faces of the drawer rail 3. It is also possible to imagine that, in the state with the roller carriage 16 arranged on the cabinet rail 2, the bearing faces 25, 26 of the latch elements 23, 24 protrude farther from the guide faces 17, 18 than the roll faces 27, 28, 29 of the rollers 30, 31, 32 (FIGS. 8 and 9). The reverse is also conceivable, where the roll faces 27, 28, 29 of the rollers 30, 31, 32 protrude farther from the guide faces 17, 18 than the bearing faces 25, 26 of the latch elements 23, 24.

It is also advantageous that the latch elements 23, 24 are present lying diagonally opposite each other on outsides 21, 22 of the roller carriage 16. The latch element 23 is formed on the cage 19 of the roller carriage 16 in such a way that it does not touch the guide face 18 of the cabinet rail 2. The latch element 23 is spaced apart from the guide face 18. A recess 34 is provided between a top 33 and the latch element 23 of the cage 19; in this way the latch element 23 is present elastically, e.g. resiliently, on the cage 19 (FIG. 9).

A stop element 37 is bent out like a flag on the cabinet rail 2. An abutment element 38 is arranged on the drawer rail 3 and abuts against the stop element 37 during a closure movement of the drawer rail 3 relative to the cabinet rail 2. In the state with the abutment element 38 bearing on the stop element 37, the force accumulator 35 of the automatic retraction mechanism 4 of the pull-out guide 1 is in this way advantageously maintained under prestressing (FIG. 10).

Figure 12:
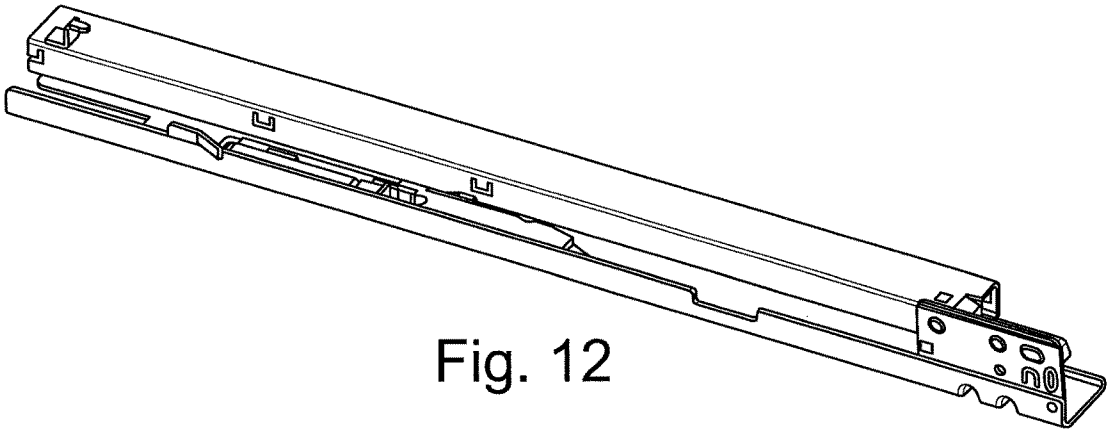
FIGS. 12 and 13 show a perspective view, laterally from the outside, front and above, of a pull-out guide designed as a full-extension pull-out, firstly in a closed state (FIG. 12) and secondly in an opened state (FIG. 13)
Figure 13:
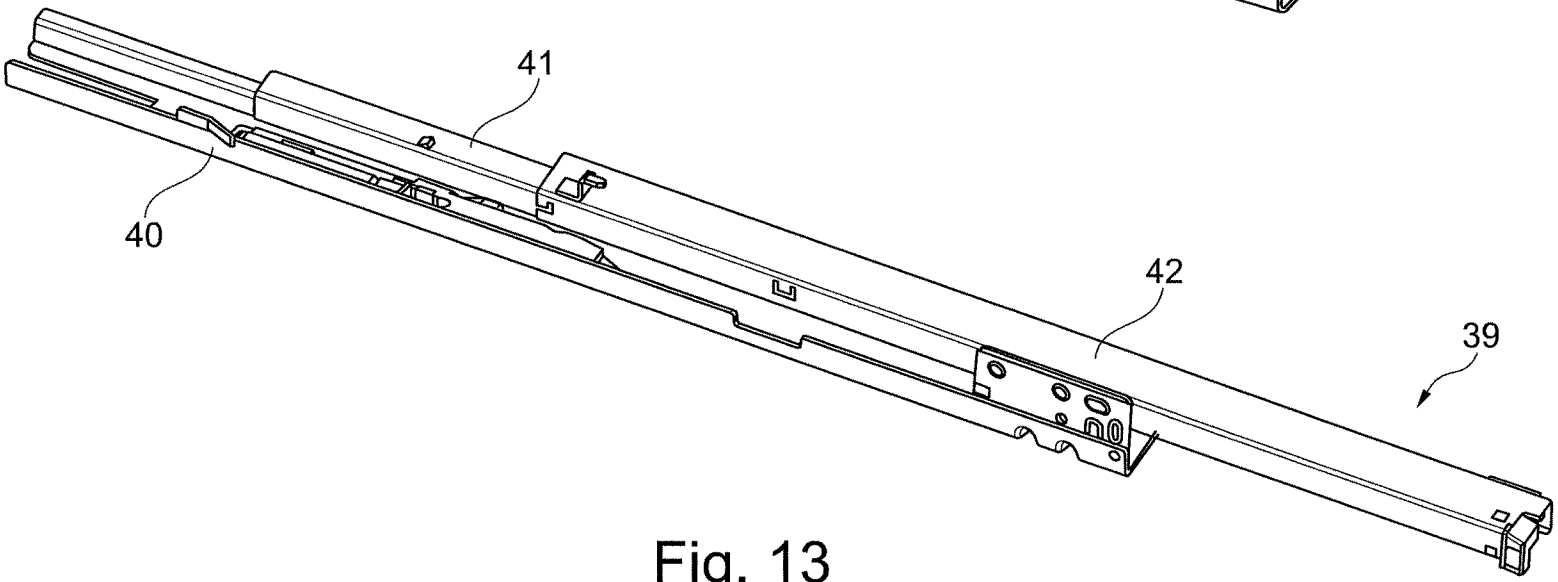

FIGS. 12 and 13 show a pull-out guide 39 according to the present invention in the form of a full-extension pull-out, consisting of a cabinet rail 40, a central rail 41 and a drawer rail 42.

Figure 14:
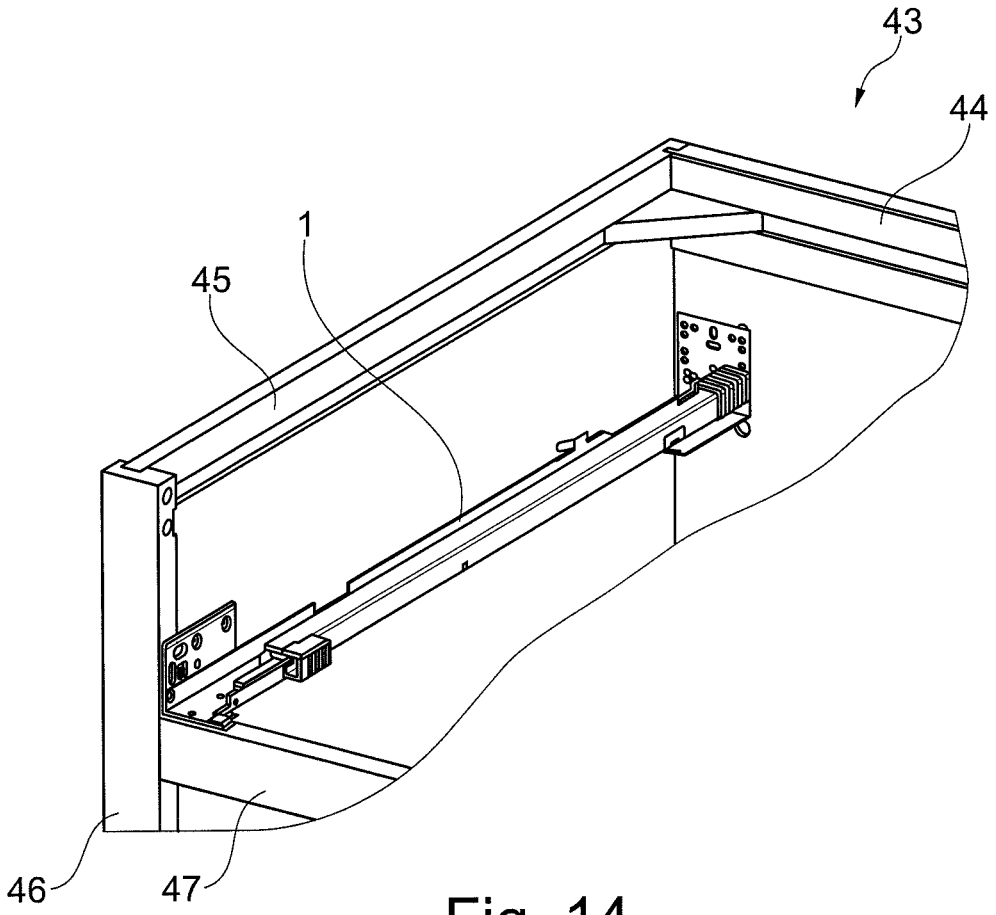
FIG. 14 shows a perspective view, laterally from the front and above, of a detail of an item of furniture with an arranged pull-out guide according to FIG. 1.

FIG. 14 shows an item of furniture 43 consisting, inter alia, of a furniture rear wall 44, a furniture side wall 45 and furniture front struts 46, 47. A pull-out guide 1 is arranged on the item of furniture 43. The pull-out guide 1 is mounted, in a rear area 13, onto the furniture rear wall 44 and, in an opposite front area 5, is secured on and rests on the furniture front strut 47 and is secured on the furniture front strut 46.

LIST OF REFERENCE SIGNS

1 pull-out guide
2 cabinet rail
3 drawer rail
4 retraction mechanism
5 end area
6 bearing member
7 support face
8 support position
9 bearing roller
10 support element
11 guide face
12 ramp
13 end area
14 underside
15 rotation axle
16 roller carriage
17 guide face
18 guide face
19 cage
20 edge
21 outside
22 outside
23 latch element
24 latch element
25 bearing face
26 bearing face
27 roll face
28 roll face
29 roll face
30 roller
31 roller
32 roller
33 top
34 recess
35 force accumulator
36 coupling element
37 stop element
38 abutment element
39 pull-out guide
40 cabinet rail
41 central rail
42 drawer rail
43 item of furniture
44 furniture rear wall
45 furniture side wall
46 furniture front strut
47 furniture front strut

The invention claimed is:

1. A pull-out guide for guiding a drawer, having a cabinet rail for attaching to a furniture cabinet, and a drawer rail for attaching to a drawer, wherein a roller carriage is provided, rollers of which roller carriage, during a movement of the rails relative to each other, roll on a guide face of the respective rail, wherein the roller carriage has a latch element, the latch element being configured so that lateral movement play of the drawer rail relative to the roller carriage is avoided, wherein the pull-out guide comprises, on the cabinet rail, an automatic retraction mechanism which, by means of a catch element, catches the drawer rail in a closure movement and moves it to a closed position relative to the cabinet rail, wherein the cabinet rail has a stop element, and the drawer rail has an abutment element, wherein, at a catch position of the cabinet rail, a distance between the stop element and the abutment element is smaller than a maximum length of movement of a coupling element of a force accumulator of the automatic retraction mechanism, wherein the distance is to be seen parallel to a direction of movement of the drawer rail.

2. The pull-out guide for guiding a drawer as claimed in claim 1, wherein the roller carriage has two latch elements, which are designed lying opposite each other on the roller carriage.

3. The pull-out guide for guiding a drawer as claimed in claim 1, wherein the latch element is elastically resilient.

4. The pull-out guide for guiding a drawer as claimed in claim 1, wherein a first rail of said cabinet and drawer rails of the pull-out guide comprises a bearing member, and a further rail of said cabinet and drawer rails comprises a support element, wherein the bearing member, in the fully opened state of the first rail relative to the further rail, touches the support element in order to support the first rail.

5. The pull-out guide for guiding a drawer as claimed in claim 4, wherein the bearing member is bent out from the first rail.

6. The pull-out guide for guiding a drawer as claimed in claim 4, wherein the support element comprises a bearing roller.

7. The pull-out guide for guiding a drawer as claimed in claim 4, wherein the bearing member has a ramp for the bearing roller of the support element.

8. The pull-out guide for guiding a drawer as claimed in claim 1, wherein the stop element is bent out from the cabinet rail.

9. The pull-out guide for guiding a drawer as claimed in claim 1, wherein the abutment element is mounted on the drawer rail.

10. An item of furniture with a pull-out guide as claimed in claim 1.

11. A pull-out guide for guiding a drawer, having a cabinet rail for attaching to a furniture cabinet, and a drawer rail for attaching to a drawer, wherein a roller carriage is provided, rollers of which roller carriage, during a movement of the rails relative to each other, roll on a guide face of the respective rail, characterized in that the pull-out guide comprises, on the cabinet rail, an automatic retraction mechanism which, by means of a catch element, catches the drawer rail in a closure movement and moves it to a closed position relative to the cabinet rail, wherein the cabinet rail has a stop element, and the drawer rail has an abutment element, wherein, at a catch position of the cabinet rail, a distance between the stop element and the abutment element is smaller than a maximum length of movement of a coupling element of a force accumulator of the automatic retraction mechanism, wherein the distance is to be seen parallel to a direction of movement of the drawer rail.

12. A pull-out guide for guiding a drawer, having a cabinet rail for attaching to a furniture cabinet, and a drawer rail for attaching to a drawer, wherein a roller carriage is provided, rollers of which roller carriage, during a movement of the rails relative to each other, roll on a guide face of the respective rail, wherein a first rail of said cabinet and drawer rails of the pull-out guide comprises a bearing member, and a further rail of said cabinet and drawer rails comprises a support element, wherein the bearing member, in the fully opened state of the first rail relative to the further rail, touches the support element in order to support the first rail, wherein the pull-out guide comprises, on the cabinet rail, an automatic retraction mechanism which, by means of a catch element, catches the drawer rail in a closure movement and moves it to a closed position relative to the cabinet rail, wherein the cabinet rail has a stop element, and the drawer rail has an abutment element, wherein, at a catch position of the cabinet rail, a distance between the stop element and the abutment element is smaller than a maximum length of movement of a coupling element of a force accumulator of the automatic retraction mechanism, wherein the distance is to be seen parallel to a direction of movement of the drawer rail.

* * * * *